United States Patent [19]

Toft

[11] Patent Number: 5,009,441

[45] Date of Patent: Apr. 23, 1991

[54] SKI BOARD BINDING

[76] Inventor: Lonnie P. Toft, 345 Arcade Dr., Ventura, Calif. 93003

[21] Appl. No.: 525,615

[22] Filed: May 21, 1990

[51] Int. Cl.[5] ..... A63C 9/083; A63C 5/03; B63B 35/79; B63B 35/81

[52] U.S. Cl. ..... 280/14.2; 280/616; 280/621; 280/634; 24/129 A; 24/300; 441/70; 441/74

[58] Field of Search ..... 280/616, 619, 621, 623, 280/633, 634, 637, 600, 607, 11.14, 11.36, 14.1, 14.2, 14.3; 441/58, 61, 62, 63, 68, 70, 74, 75, 76; 24/129 A, 129 R, 300

[56] References Cited

U.S. PATENT DOCUMENTS

| | | | |
|---|---|---|---|
| 2,445,610 | 7/1948 | Drake | 441/70 |
| 2,509,603 | 5/1950 | Marin | 441/68 X |
| 3,143,750 | 8/1964 | Kluge | 441/70 |
| 4,604,070 | 8/1986 | McKee et al. | 441/70 |
| 4,864,695 | 9/1989 | Gold | 24/300 X |
| 4,898,345 | 2/1990 | Clayton | 441/74 X |
| 4,915,400 | 4/1990 | Chambers | 280/14.2 |
| 4,955,632 | 9/1990 | Giarritta et al. | 280/607 |

FOREIGN PATENT DOCUMENTS

| | | | |
|---|---|---|---|
| 2446656 | 9/1980 | France | 441/70 |
| 2630922 | 11/1989 | France | 280/14.1 |

*Primary Examiner*—Andres Kashnikow
*Assistant Examiner*—Brian Johnson
*Attorney, Agent, or Firm*—Jack C. Munro

[57] ABSTRACT

A binding assembly for a structure which is designed to facilitate rapid movement along the surface of the earth such as a ski board for water wherein the binding assembly includes an elastic cord which when stretched permits tightening of the binding assembly to thereby securely clamp the user's foot to the structure. Once the binding assembly has been adjusted to the desired amount of securement, release of the elastic cord results in the binding assembly remaining in that established level of securement.

8 Claims, 1 Drawing Sheet

10
12
30
14
28
24
22
20
2
26
44
20
32
40
2
38
54
16
28
30
22
32
38
44
40
18

34
38
44
33
22
32
3
40
3
12
38
42
20
26
46
10

34
36
26
42
33
12
40
38

48
38
12
33
42
34
40
36

32
22
38
52
40
44
12
26
38
10
42
20
46

SKI BOARD BINDING

BACKGROUND OF THE INVENTION

The field of this invention relates to a releasable binding for a human foot on a ski board or other similar type of structure.

The purpose of a binding is to keep the foot of the human being firmly located on the structure on which the foot is located. Typical structures would be a snow ski, water ski and ski board. Ski boards can be used on both snow and water. All bindings that are constructed at the present time are designed to be releasable. The releasable binding can be adjusted to become undone when the force that is applied to the human being user in relation to the structure exceeds a certain limit. The intent and purpose of such a releasable binding is to prevent broken bones and torn ligaments as well as other medical problems.

In conjunction with snow skis, releasable bindings have matured to a rather complicated structure. The reason for the complication in conjunction with snow skis is that the snow skier is capable of moving at a rather fast speed and may rapidly encounter a potentially damaging force. Skis and ski boards that are designed for water do not require such a complicated binding. However, the binding does have to be strong enough to hold the water ski structure onto the feet of the user while making quick turns and/or jumps.

In the construction of any binding; the factors involved are: (1) comfort; (2) strength; (3) adjustability; (4) ease of operation; (5) complexity; (6) durability; and (7) expense. "Comfort" means that the binding has to snugly secure the feet of the user but yet exhibit a cushiony feel. "Strength" means that the binding must physically be strong enough to securely retain the foot of the user even when the user is making strenous maneuvers such as rapid turns or jumps. "Adjustability" is so that the binding is capable of being securely positioned on both a small size foot and a large size foot. "Ease of operation" means that the binding requires only a minimal number of steps to securely position the user's foot in conjunction with the binding. "Complexity" means utilizing of a minimal number of parts to minimize the complexity of construction of the binding. "Durability" means constructing the binding to not break even when subjected to strenuous forces and also to be substantially unaffected by prolonged exposure to water and sunlight. "Expense" means the binding is capable of being manufactured at a decreased manufacturing expense and therefore sold to the ultimate consumer at a reasonable price.

SUMMARY OF THE INVENTION

The releasable binding of the present invention is composed of a heel strap assembly and an instep strap assembly with the heel strap assembly being located across the heel of the human foot. The instep strap assembly is located across the instep of the human foot. One end of the instep strap assembly is secured to one end of the heel strap assembly. The remaining end of the instep strap assembly and the heel strap assembly are connected together through an elastic cord which is fixedly secured to the heel strap assembly. The elastic cord is snugly located within a tube. The elastic cord can be stretched decreasing its diameter, thereby permitting the elastic cord to move relative to the tube providing adjustability of the binding assembly. Once the desired adjustability has been obtained, release of the elastic cord causes immediate expansion of the cord thereby assuming a snug position within the tube thereby maintaining the binding assembly in its established adjustable position. Both the heel strap assembly and the instep strap assembly include cushiony pads so as to be comfortable to the user. There may be utilized a plurality of binding assemblies mounted on a given structure with the elastic cords of the separate binding assemblies being connectable together and, upon manual stretching force being applied to the cords, simultaneous operation of both binding assemblies will occur.

The primary objectives of the releasable binding of the present invention is to have a binding be comfortable to the user, high in strength, easy to adjust to various sizes of feet, operated easily with a minimum amount of skill at minimal complexity, being of minimal expense to manufacture and to be durable even after prolonged exposure to adverse environments.

DETAILED DESCRIPTION OF THE SHOWN EMBODIMENT

Figures 1, 2, 3, 4, 5:
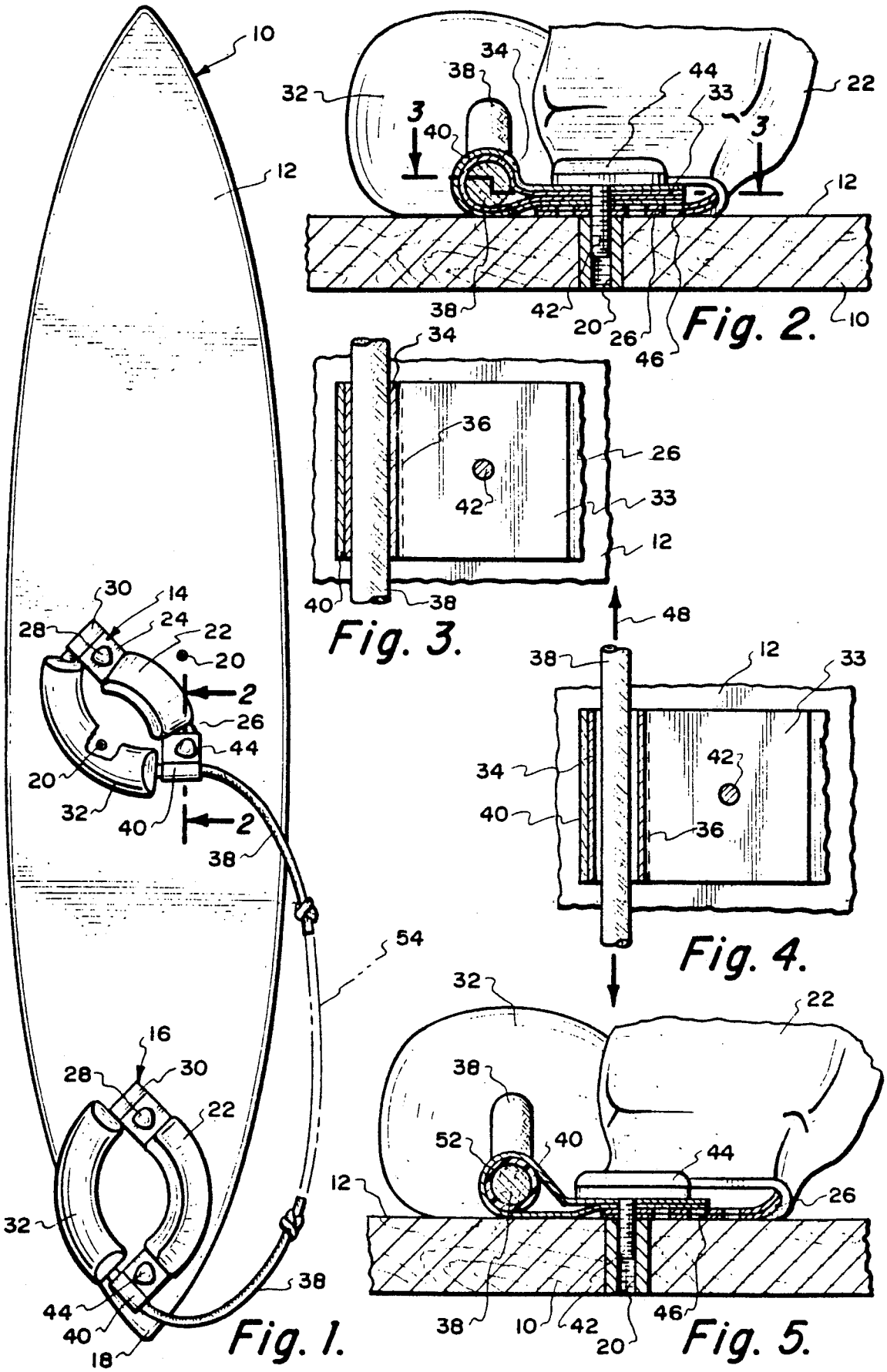
FIG. 1 is a top plan view of a ski board upon which there are mounted a pair of binding assemblies forming the releasable binding of the present invention.
FIG. 2 is a view, partly in cross-section, through one of the binding assemblies mounted on the ski board shown in FIG. 1 taken along line 2—2 of FIG. 1.
FIG. 3 is a cross-sectional view taken along line 3—3 of FIG. 2 showing the elastic cord included within the binding assembly in its at-rest position.
FIG. 4 is a view similar to FIG. 3 but showing the elastic cord in a stretched position.
FIG. 5 is a view similar to FIG. 2 but of a modified form of binding assembly of the present invention.

Referring particularly to the drawing, there is shown a ski board 10 which has an upper surface 12 upon which there is mounted the binding assemblies 14 and 16 of the present invention. Basically the binding assemblies 14 and 16 are identical with binding assembly 14 being mounted substantially adjacent the mid-point of the longitudinal length of the ski board 10 with the binding assembly 16 being mounted directly adjacent the stern 18 of the ski board 10. Incorporated within the board 10 are four in number of threaded holes 20 in the area of mounting for the binding assembly 14. It is to be noted that only two in number of the threaded holes 20 will be used at any given time. The reason that four in number of the threaded holes 20 are provided is so that the binding assembly 14 can be mounted in the position shown in FIG. 1 of the drawing and also in a position ninety degrees displaced from that position. This permits the binding assembly 14 to be oriented to accommodate the left foot of the user or to be oriented to accommodate the right foot of the user according to the individual user's desire.

Because each binding assembly 14 and 16 are identical, like numerals will be utilized to refer to like parts. Both binding assemblies 14 and 16 include an instep strap assembly which comprises a cushiony pad 22 which has webbing strips 24 and 26 extending from opposite ends of the cushiony pad 22. In actual practice, the webbing strips 24 and 26 will most likely be an integral strip of material which extends through the cushiony pad 22. A typical material of construction for the webbing strips 24 and 26 would be a nylon or some other similar type of material.

The webbing strip 24 includes a hole (not shown) through which is conducted a threaded bolt (not shown) which is mounted on enlarged polygonal shaped head 28. The head 28 can be manually turned with the bolt to threadably engage with one of the threaded holes 20. The bolt connected to the head 28 also is conducted through a hole formed within a webbing 30 with the webbing 30 being secured to cushiony pad 32 of the heel strap assembly. The bolt which is attached to the enlarged head 28 functions to securely mount one end of the instep strap assembly and one end of the heel strap assembly in a substantially fixed position on the board 10.

Placed in juxtaposition with the webbing strip 26 is a webbing strip 33 which is located in an overlapping arrangement forming a tube 34. The diameter of the tube 34 is selected so that the tube 34 will be in snug contact with elastic cord 38 when elastic cord 38 is in the at-rest position. The construction of the tube 34 is accomplished by sew line 36 on the webbing 33. The webbing 33 is covered by protective cover 40. The protective cover 40 as well as the webbing strip 33 has holes which are to be aligned and connect with threaded bolt 42 of enlarged polygonal shaped head 44. It is to be noted that the webbing strip 26 has a plurality of holes 46. By varying which hole 46 the bolt 42 connects with, there is provided an initial adjustment between the instep strap assembly and the heel strap assembly for the binding 14 to accommodate generally to a large sized foot or a smaller foot. Additional adjustment is achieved by stretching of elastic cord 38 as shown in FIG. 4 of the drawing. This permits elastic cord 38 to be moved relative to the walls of the tube 34 since elastic cord 38 has assumed a smaller diameter.

Movement of the cord 38 in an outward direction represented by arrow 48 will cause the cushiony pad 32 to tightly bind against the heel (not shown) of the foot of the user. Once the desired securement has been obtained of the cushiony pad 32 against the heel which is obtained strictly by "feel" of the user, the force being applied to the elastic cord 38 is released which results in the elastic cord 38 expanding into a larger diametered position shown in FIG. 3 and again tightly binding against the walls of the tube 34. Therefore, the established position is maintained with the foot of the user being securely held in position but yet being releasable therefrom upon an unexpected force of sufficient magnitude being encountered by the board 10 or by the user.

The binding assemblies 14 and 16 can be operated individually if the cords 38 are not connected or if the cords 38 are connected, as by connecting section 54, then a single outward force, as is represented in the direction arrow 48, will operate simultaneously both binding assemblies 14 and 16.

Referring particularly to FIG. 5, the webbing strip 33 has been eliminated and a single plastic tube 52 is located about the elastic cord 38. This tube 52 will be fixedly secured in some conventional manner such as be adhesive within the outer cover 40. Normally the outer cover 40 will be constructed of a webbing material such as nylon.

What is claimed is:

1. A releasable binding for mounting a foot of a human being onto a structure designed for movement on the surface of the earth, said binding comprising:

a binding assembly composed of a heel strap assembly and an instep strap assembly, said heel strap assembly adapted to be located across the heel of a human foot, said instep strap assembly having a first end and a second end and adapted to be located across the instep of the human foot, said heel strap assembly including an elastic cord, said elastic cord having a first terminal fixedly connected to said first end and a free end adapted to be manually grasped and longitudinally movable from an at-rest position to a stretched position, said elastic cord being mounted in a tube of fixed cross-section and fixedly secured to said second end of said instep strap assembly, with said free end in said at-rest position said elastic cord being of a thickness tightly frictionally engaging with said tube effectively securing together said tube and said elastic cord, with said free end in said stretched position the thickness of said elastic cord is decreased which permits longitudinal sliding movement between said elastic cord and said tube so that said heel strap assembly is to be snugly secured against the heel of the human foot, upon manual release of said free end said heel strap assembly maintains said binding against the heel.

2. The releasable binding as defined in claim 1 wherein:

said binding assembly being capable of being mounted at any one of a plurality of different positions on said structure.

3. The releasable binding as defined within claim 1 wherein:

said heel strap assembly including a first cushiony pad adapted to be in direct contact with the heel, said instep strap assembly including a second cushiony pad adapted to be in direct contact with the instep.

4. The releasable binding as defined in claim 1 wherein:

said heel strap assembly is integral with said instep strap assembly.

5. The releasable binding as defined in claim 1 wherein:

there being a pair of said binding assemblies mounted in a spaced apart manner on said structure, said elastic cords of said binding assemblies being connected together, application of a manual pulling force to said connected together elastic cords results in simultaneous operation of both said binding assemblies.

6. A releasable binding for mounting a foot of a human being onto a structure designed for movement on the surface of the earth, said binding comprising:

a binding assembly composed of a heel strap assembly and an instep strap assembly, said heel strap assembly adapted to be located across the heel of a human foot, said instep strap assembly having a first end and a second end and adapted to be located across the instep of the human foot, said heel strap assembly including an elastic cord, said elastic cord having a first terminal fixedly connected to said first end and a free end adapted to be manually grasped and longitudinally movable from an at-rest position to a stretched position, said elastic cord being mounted in a tube of fixed cross-section, with said free end in said at-rest position said elastic cord being of a thickness tightly frictionally engaging with said tube effectively securing together said tube and said elastic cord, with said free end in said stretched position the thickness of said elastic cord is decreased which permits longitudinal sliding movement between said elastic cord and said tube so that said heel strap assembly is to be snugly secured against the heel of the human foot, upon manual release of said free end said heel strap assembly maintains said binding against the heel, whereby upon said structure and human being incurring an unexpected excessive level of force said elastic cord of said binding assembly will be stretched providing longitudinal sliding movement of said elastic cord within said tube releasing the binding force against the heel which then permits disassociation of the foot from said structure without injury; and said tube being fixedly secured to said second end of said instep strap assembly.

7. The releasable binding as defined in claim 6 wherein:

said tube is constructed from a strip of webbing.

8. The releasable binding as defined in claim 6 wherein:

said tube is constructed of plastic.

* * * * *